US010030346B2

(12) United States Patent
Takeshima et al.

(10) Patent No.: US 10,030,346 B2
(45) Date of Patent: Jul. 24, 2018

(54) DIRECT POWER COMPACTION METHOD

(71) Applicant: JAFEC USA, Inc., San Jose, CA (US)

(72) Inventors: Shigeru Takeshima, San Carlos, CA (US); Tsuyoshi Takahashi, Miyagi-ken (JP)

(73) Assignee: JAFEC USA, Inc., San Jose, CA (US)

( * ) Notice: Subject to any disclaimer, the term of this patent is extended or adjusted under 35 U.S.C. 154(b) by 0 days.

(21) Appl. No.: 15/619,542

(22) Filed: Jun. 12, 2017

(65) Prior Publication Data

US 2017/0275841 A1 Sep. 28, 2017

Related U.S. Application Data

(63) Continuation of application No. 15/167,984, filed on May 27, 2016, now Pat. No. 9,702,108.

(60) Provisional application No. 62/167,864, filed on May 28, 2015.

(51) Int. Cl.

| | |
|---|---|
| ***E02D 3/054*** | (2006.01) |
| ***E02D 7/18*** | (2006.01) |
| ***E02D 3/046*** | (2006.01) |

(52) U.S. Cl.

CPC ..... *E02D 3/054* (2013.01); *E02D 3/046* (2013.01); *E02D 7/18* (2013.01)

(58) Field of Classification Search

CPC ..... E02D 3/08; E02D 3/046; E02D 3/054; E02D 3/068; E02D 3/074; E02D 3/123

USPC ..... 405/271

See application file for complete search history.

(56) References Cited

U.S. PATENT DOCUMENTS

| | | | | |
|---|---|---|---|---|
| 3,256,789 | A * | 6/1966 | De Biasi | E02D 3/054 37/396 |
| 3,498,066 | A * | 3/1970 | Matsumoto | E02D 3/054 405/244 |
| 3,865,501 | A * | 2/1975 | Kniep | E02D 3/054 173/49 |
| 4,080,792 | A * | 3/1978 | Anderson | E02D 3/054 405/271 |
| 4,126,007 | A * | 11/1978 | Mars | E02D 3/08 405/240 |
| 4,397,590 | A * | 8/1983 | Friesen | E02D 3/054 405/154.1 |
| 5,123,782 | A * | 6/1992 | Yoshida | E02D 3/054 405/233 |

(Continued)

FOREIGN PATENT DOCUMENTS

JP 04363410 A * 12/1992

*Primary Examiner* — Frederick L Lagman
(74) *Attorney, Agent, or Firm* — Patent2ip LLC

(57) ABSTRACT

The system, method and apparatus described relates generally to a method of Direct Power Compaction (DPC). In one example embodiment to methods, apparatus, and systems to compact loose ground by vibration and compaction of H piles driven by vibrators or drivers (vibro-hammer). The DPC method is an efficient and highly economical technique for densifying loose soils. In the procedure piles, with an innovative H pattern structure, are driven in the ground using a combination of downward and vibratory force to move particles of the loose or sandy soil closer together and reduce the voids between them. Subsequent backfilling and vibration at the H-pile sites achieves the highest density possible and provides for an improvement ground soil structure and load bearing capacity.

2 Claims, 11 Drawing Sheets

(56) References Cited

U.S. PATENT DOCUMENTS

| | | | | |
|---|---|---|---|---|
| 5,328,299 | A * | 7/1994 | Degen | E02D 3/054 405/232 |
| 6,517,292 | B1 * | 2/2003 | Landau | E02D 3/08 175/20 |
| 8,328,470 | B2 * | 12/2012 | Maher | E02D 3/046 405/232 |
| 8,360,689 | B2 * | 1/2013 | Maher | E02D 3/046 405/233 |
| 8,419,316 | B2 * | 4/2013 | Hodge | E02D 3/054 405/271 |
| 8,740,501 | B2 * | 6/2014 | Maher | E02D 3/046 405/233 |
| 9,702,108 | B2 * | 7/2017 | Takeshima | E02D 3/054 |

* cited by examiner

DIRECT POWER COMPACTION METHOD

This application is a continuation of and claims priority from U.S. Ser. No. 15/167,984 filed May 27, 2016, entitled "DIRECT POWER COMPACTION METHOD", which claim priority from U.S. Provisional Application No. 62/167,864 filed on May 28, 2015, entitled 'Power Compaction Method', which are all incorporated herein by reference.

FIELD OF TECHNOLOGY

This disclosure relates generally to a method of Direct Power Compaction (DPC). In one example embodiment to methods, apparatus, and systems to compact loose ground by vibration and compaction of H piles driven by vibrators (vibro-hammer or pile driver). The DPC method is an efficient and highly economical technique for densifying loose soils. In the procedure piles, with an innovative H pattern structure, are driven in the ground using a combination of downward and vibratory force to move particles of the looses oil closer together and reduce the voids between them. Subsequent backfilling and vibration at the H-pile sites achieves the highest density possible and provides for an improved ground soil structure and load bearing capacity.

BACKGROUND

Because of the shortage of usable land in industrial areas, especially along waterfront sites, there has been a recent trend towards building large industrial complexes, such as power plants, steel mills, and shipyards on landfill sites or other sites with a loose top soil or soil layer. Additionally, there are several projects presently being planned for construction of large intercontinental airports on landfill sites along the coasts of the United States and the Great Lakes, as well as other sites along other lakes, oceans and rivers around the world.

In conventional landfill construction projects, the fill is generally provided by depositing relatively solid dry materials along the ocean or water bed, or in the case of swamp land, depositing clean dry fill along the swamp until a firm foundation had been established. Due to the enormous expense of trucking or transporting in fill, and the time and material necessary, the costs involved for conventional land filling have become almost prohibitive when compared to the actual costs of the buildings and facilities constructed on the filled areas, alternative locations and the projected revenue from building in new locations. Thus, there is a need for an invention that converts location specific sub-par land fill or loose soil areas into usable land.

Recently, new techniques of land filling have been developed involving the hydraulic sand filling of swampy or underwater sites. Generally, this method uses slurry of earth and water from a nearby ocean or lakebed that is hydraulically pumped through a large pipe to the fill site. The slurry is deposited on the fill site and the water drains away, depositing the solid material. With this method it is possible to simultaneously dredge the adjacent river or ocean bed while using the fill area as a depository for the dredged material, of which is a markedly efficient process.

When hydraulic landfill is used, the material, which is generally granular in nature, must first be compacted prior to commencing any construction thereon. This fill can be compacted by allowing the sand or loose soil to naturally settle over a sufficiently long period of time, usually a matter of months or years, depending on the degree of compaction needed, which in turn is dependent upon the type of material and the weight of any contemplated construction. Alternatively, mechanical means can be used to force the water out of the sand thereby achieving compaction. Generally, this involves large rolling drums, which are rolled back and forth over the material, compacting it as it is deposited of which the rolling drums method, among other prior art methods, takes time, and as mentioned below, are sometimes unfeasible due to environmental circumstances, cost limitations or space limitations.

When hydraulic landfill is used, continual mechanical compaction is sometimes impossible because of the high fluid consistency of the fill immediately after it is deposited. Even when sufficient drainage has occurred, rolling is time consuming and generally ineffective for sufficient compaction at substantial depths. Natural settlement is unsatisfactory because of the amount of time necessary during which no construction can take place.

Because hydraulic landfill projects will often require use of up to 20 or 30 feet of fill to form a sufficient base for a foundation, it is necessary that the compaction be uniformly achieved to substantial depths. This becomes especially important in situations where large facilities are to be subsequently constructed. Pounding or rolling the surface to effect compaction will not provide a sufficient degree of compaction more than a few feet below the surface and it becomes necessary to have some sort of soil penetrating device to compact the soil lower down.

Prior soil compaction systems applicable to hydraulically filled areas and which provide sufficiently deep penetration have employed one of the varying types of penetrating torpedo-type devices which are solid in nature and are lowered down through the soil to some depth. Once lowered, the particular device is set into vibration by a rotating eccentric or other appropriate means, thereby compacting the soil. These prior devices have proven unsatisfactory for certain applications in that they require a separate means for forcing them to a lowered position in the ground, and the hole through which the device is lowered and raised must be back-filled with uncompact fill, once the device is withdrawn.

It is therefore an object of this invention to provide a device for vibration-compacting a loose ground capable of reducing construction cost by simultaneously improving the ground in a wide range by rod compaction method. Another object of the invention is to provide a method of compacting soil or other granular materials that will provide a relatively high degree of compaction. Another object of the invention is to provide a method of compacting soil or other granular material that will provide a high degree of compaction to relatively large depths. Another object of the invention is to provide a method of compacting soil or other granular material that will not require additional material to backfill holes through which the compacting device is lowered into the soil. Another object of the invention is to provide a method of compacting soil or other granular material, which can be operated, with a minimum expenditure of time and manpower as the invention will provide for an ability to compact soil over a larger footprint than prior art. Another object of the invention is to provide an apparatus for the compaction of soil or other granular materials.

SUMMARY

Disclosed are methods, apparatus, and systems to provide a device for vibration-compacting a loose soil ground via Direct Power Compaction (DPC). As disclosed herein, a device for vibration-compacting a loose soil ground may be formed by multiple parts. A crane or other structure ay provide a fixed point or a main cable of which the present invention may be attached to. A shock absorber or damper may be fixed to the main cable, of which a vibrator device such as a vibro-hammer or pile driver may be secured under. A rod mounting plate of which may transmit vibration and force to a multitude of rods or piles, may be attached to the bottom output of the vibrator device. A plurality of rods may be vertically fixed to the lower surface of the plate using adapters at specified intervals, such as in a preferred embodiment, four rods may be attached in an H pattern. The vibrator device may be connected to the main wire rope of a crawler crane as to be vertically moved integrally with the rod mounting beam and the rod. The device may also enlist a holding plate position at the bottom section of the rods, wherein the holding plate comprises of a box metal holding body with loosely fitting holes, allowing the vertical movement of the rods through the holes or recesses in the holding plate and maintaining the interval between the rods constant. Each rod may be loosely fitted through the loose insertion hole of each rod formed on the holding body. The holding body may be connected to the auxiliary wire rope of the crawler crane for stability and strength. The compaction strength control also may be possible on an as-needed basis by controlling driving pitch, force and the cycle of compaction, and so forth.

In this aspect, the method may comprise using the above described H-piles or rods. Vibratory energy may be delivered directly into the ground. The typical configuration may be a quadruple axial DPC rig with a vibro-hammer at the top of each pile wherein the quadruple rods may be position in an H pattern. The extent of the treatment required for optimal densification or compaction may depend on the ground or soil content, grain size/geometry and other factors such as materials, of the soil being compacted. The best results may be realized in sandy soils with low fines content. For loose sands/granular soils, the DPC method yields may result equivalent to those of other densifications/compaction methods, but the simplicity and speed of the DPC method may make it the most efficient and economical solution for improvement of sandy soils.

Another aspect of the disclosure may include a system in which H shaped piles may first be driven into the ground through a combination of the structure such as the crane lowering the present invention such that the rods may penetrate into the ground along with the effects of the vibrating device, of which enables penetration into the ground, but also vibration of the surrounding soil, helping to minimize the void between the soil materials and compact the soil. When the rods reach the required depth, they may then be pulled up by a distance and inserted again by a distance. The ground may be compacted by the vibration of the vibro-hammer transmitting through the rods while the repetition of driving and withdrawing the rods is repeated. As the area under the rods becomes more compacted, the rods may withdraw more, and drive to a lesser depth every cycle, thus retreating the rods over cycles as the ground becomes compacted, until the rods are retreated to ground level and the entirety of the ground site is compacted. The above process may be executed while backfilling supply sand or another material, such as gravel at the ground surface hence the ground surface would not be lowered by the compaction effect. The lengths of pulling up distance and of the driving in distance may be calculated from the void ratio on the original ground of n value and the design ratio of n value, while the lengths may determine the driving pitch.

Yet another aspect of the disclosure may include an apparatus for the compaction of granular material comprising an elongated hollow member that is set into vibration by a constant vibrating hammer, the member and hammer being suspended from a crane-like apparatus. While in constant vibration, the member may be lowered into the ground in a substantially vertical position to a predetermined depth, maintained in the lowered position for a period of time, and then withdrawn. The same procedure may be repeated at a plurality of locations.

In this aspect, such apparatus, and systems may comprise methods to implement the methods described heretofore.

The methods and systems disclosed herein may be implemented in any means for achieving various aspects. Other features will be apparent from the accompanying drawings and from the detailed description that follows.

BRIEF DESCRIPTION OF THE DRAWINGS

Example embodiments are illustrated by way of example and are not limited to the figures of the accompanying drawings, in which, like references indicate similar elements.

Figure 1A:
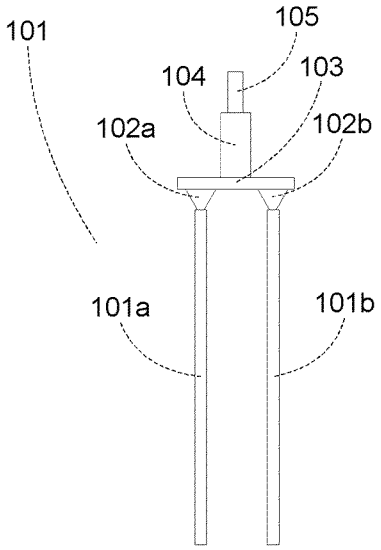
FIG. 1A-1F are component and detailed representations of the present invention direct power compacting rig with vibration and driving device, according to one or more embodiments.

Other features of the present embodiments will be apparent from the accompanying drawings and from the detailed description that follows.

DETAILED DESCRIPTION

Disclosed are methods, apparatus, and systems to compact loose ground soil by vibration and compaction of H rods or piles driven by a vibration and driving device such as a vibro-hammer or other apparatus such as a pile driver. Although the present embodiments have been described with reference to specific example embodiments, it will be evident that various modifications and changes may be made to these embodiments without departing from the broader spirit and scope of the various embodiments. In addition, the components shown in the figures, their connections, couples, and relationships, and their functions, are meant to be exemplary only, and are not meant to limit the embodiments described herein.

In one or more embodiments, which may be in addition to the above and below embodiments, the present invention may describe a direct power compacting rig.

In one or more embodiments, which may be in addition to the above and below embodiments, the present invention may describe a direct power compacting rig with one or more rods to be driven into the ground for compaction or solidification purposes.

In one or more embodiments, which may be in addition to the above and below embodiments, the present invention may describe a direct power compacting rig with one or more rods to be driven into the ground for compaction or solidification purposes and a vibration and driving device such as a vibro-hammer connected to the rods, such that the vibro hammer may vibrate and transmit vibration and force into the ground soil as the rods move to a specific depth.

In one or more embodiments, which may be in addition to the above and below embodiments, the present invention may describe a direct power compacting rig with one or more rods to be driven into the ground for compaction or solidification purposes and attached to the main cable of a crane. It is noted that the crane maybe substituted for any other structure or machine such as a building, scaffolding structure, etc. The crane or structure may be moveable or mobile, and may be mounted or placed on the ground, or also may be water borne such as on a boat or barge, or moveable by any other method. As well as this it may be noted that the crane or other structure may move the present invention rig in any x, y or z direction in respect to the ground plane so that the point where work is done may be changed by the operator.

In one or more embodiments, which may be in addition to the above and below embodiments, the present invention may describe a vibration and driving device such as vibro-hammer attached or connected to the main wire cable of a crane or other structure of which in a preferred embodiment, the majority of the rig weight may be placed on the main cable. It is noted that in other embodiments, for other structures, multiple cables or ropes may be used, and in some embodiments, solid mounting points may be preferable, such as a solid mount to an articulating crane structure etc. The structure or crane may be water based such as on a floating barge or ship or land based such as a crawler crane or overhead crane. The structure or crane may be stationery, moving, rotating or of any type, either through the movement of the crane or structure mechanism, such as a tilting or rotating crane structure, or by moving the structure or crane itself to position the present invention over the intended compaction sites.

In one or more embodiments, which may be in addition to the above and below embodiments, the present invention may describe a vibration and driving device such as vibro-hammer attached or connected to the main wire cable of a crane or other structure of which in a preferred embodiment, the majority of the rig weight may be placed on the main cable and of which the main cable, or cables may lower the rig, and driving rods into the ground, such that either through the weight of the rig, the weight of the rig and the effects of the vibration and driving device, or through the use of other aides in addition, the rods may penetrate into the ground soil to a specific depth. It is noted that the vibration and forces of the rods may be transmitted into the ground, as is known in the art, the loose ground soil, or ground soil may compact, as the force and vibration reduced the voids between the particles of the soil, and thus the soil becomes improved. It is also noted that the force may radiate out from the rods, such that the rods may effect an immediate and proximate area of which may be compacted. Some of these methods may be termed as Direct Power Compaction Method (DPC), but may be among others enabled by the device.

The crane or structure of which the present invention vibration and driving rig is mounted on may raise and lower the rig through any method, such as on a typical crane, wherein the main cable is retracted via pulleys and motors. Other methods may include raising and lowering the boom of the crane and in turn raising and lowering the rig, a hydraulic ram raising and lower the rig, as well as any other methods In one or more embodiments, which may be in addition to the above and below embodiments, the present invention may describe a vibration and driving device attached or connected to a structure or crane of which in between the aforementioned connection between the vibration and driving device and the main wire or mount to the crane or structure, is a shock absorber or vibration reduction device such as a damper shock or shock system. The shock absorber may be connected to the main wire cable or other structure by a hook and loop method, or through any other method. The shock absorbing device may be mounted to the vibration and driving device through any mounting method such as solid mount between the shock absorber and vibration and driving device. In some other embodiments, the connection between the shock absorber and the vibration and driving device may be a movable or pivotable structure such as a hook and eye. The shock absorber or dampening device may be a commonly found industrial damper or shock absorber such as a hydraulic shock absorber. In other embodiments, the damper may be coil spring based, or any other type of absorber or dampener. The shock absorber or dampener may be an active element, including sensor and servos or other pieces, such as using sensors and magnetorheological dampers or other shocks of which can control the amount of vibration travelling from the vibro-hammer and associated rods to the crane or main cable. Additionally, the dampener may provide for active dampening such as a sway control device such as a tuned mass damper or active mass dampener to reduce sway of the device. Also, the shock absorber may also provide for a fundamental absorbing ability for when the entire H-beam structure, vibration and driving device and structure are lowered and raised to reduce shock to the structure, crane and associated devices and structures.

In one or more embodiments, which may be in addition to the above and below embodiments, the present invention may describe a vibrating device such as a vibro-hammer or pile driver of which is connected to the shock absorber through any method, and of which in turn is connected to the crane main cable through any method.

In one or more embodiments, which may be in addition to the above and below embodiments, the present invention may describe a vibrating device such as a vibro-hammer or pile driver of which relates to rod compaction equipment. The vibrating or driving device such as the vibro-hammer or pile driver may solidify loose soil such as sandy soil as the rods or piles are impacted and inserted into the ground at the compaction site.

In one or more embodiments, which may be in addition to the above and below embodiments, the present invention may describe a vibrating or driving device such as a vibro-hammer or pile driver and of which may use magnetic, hydraulic, electrical, steam, diesel or any other lifting or vibrating mechanism. The vibro-hammer may provide for a weight that raises and then is dropped or actively lowered in addition to the force of gravity, such that the hammer pushes a pile, rod or other mechanism or structure into the ground, transferring force into the soil or ground, and thus impacting and compressing the ground to solidify, compact or strengthen the soil or ground. This may be done at any frequency such as 1 time per a second (1 Hz), many times per a second (>1 Hz), or 1 time over many seconds (<1 Hz).

In another embodiment, the present invention may include an apparatus for the compaction of granular material comprising an elongated hollow member that is set into vibration by a constant vibrating hammer, the member and hammer being suspended from a crane-like apparatus. While in constant vibration, the member may be lowered into the ground in a substantially vertical position to a predetermined depth, maintained in the lowered position for a period of time, and then withdrawn. The same procedure may be repeated at a plurality of locations.

The mechanism for the vibratory hammer may be a vertical travel lead system, hydraulic hammer, hydraulic press in, vibratory like driver/extractor, or piling rig. The preferred embodiment may use a vibratory pile driver/extractor of which contains a system of counter-rotating weights, powered by hydraulic or electric motors, and designed in such a way that horizontal vibrations cancel out, while vertical vibrations are transmitted into the pile. Vibratory hammers can either drive in or extract a pile. Additionally, any type of hammers may be used with several different vibration rates, such as 1200 vibrations per minute to 2400 vibrations per minute, or over any range. The vibration rate may be chosen based on soil conditions at the site and other factors such as power requirements and purchase price of the equipment and needs of the operator.

In one or more embodiments, which may be in addition to the above and below embodiments, the present invention may describe a vibro-hammer, of which is connected to a vibration dampener or shock absorber, of which is connected to or hangs from a crane main cable. The vibro-hammer may then pressure, drive or vibrate, such as driving a force into a piles or rods of which then may transfer force into the ground. The present invention may provide the ability to drive multiple rods into the ground through the use of an adapter plate and adapters. The adapter plate may connect through any means to the output of the vibro-hammer and transfer force to connected rods or piles. In a preferred embodiment, this may be four or more rods.

In one or more embodiments, which may be in addition to the above and below embodiments, the present invention may describe a vibration and driving device of which is connected to a vibration dampener or shock absorber, of which is connected to or hangs from a crane main cable. The vibration and driving device may then pressure, drive or vibrate into a connecting plate, of which provides a provision to mount at least one, and preferably four rods, pile or H beams. The plate may be directly connected to the vibration and driving device, through a direct connection such as with a friction fit or interlocking structures with bolts, welds or by any other method such that a force travels from the vibration and driving device uniformly into the plate and uniformly distributes to the rods or piles. The plate may then transfer the force uniformly through the plate and into the rods, of which may typically be a hollow cylindrical steel pipe. Depending on the particular vibration and driving device and coupling arrangement used, the vibro-hammer can be attached to plate and to the pipe at any position that will enable it to set the pipes or rods into vibration such that they may impact and compact the ground soil. The plate may be of any design, and may be structured as a square plate with a length and width dimension, such that the rods may be mounted at a particular distance from each other, and a height dimension such the plate is strong enough to withstand the impact forces of the vibration and driving device and ground soil. The plate may be made of any material, wherein the material suits the demands of the system for strength, cost and weight and may be of any method such as steel or a honeycomb structure, wherein the structure may be made of any material that can transfer the forces to the rods or piles.

In one or more embodiments, which may be in addition to the above and below embodiments, the plate, as aforementioned, may be connected to up to four rods, piles or beams of which may transfer force into the ground and compact the loose soil such that the loose soil may be solidified or compacted for a purpose.

In one or more embodiments, which may be in addition to the above and below embodiments, the rods or beams may be made of any material such as steel, iron, aluminum or any other metal, alloy, composite, or mixture of materials. The beams or rods may be a single piece design, or multi piece design, wherein they may be made of different elements, welded or connected together with each section built to a purpose, such as the bottom driving end made of a stronger or harder material with a wider base such that the surface area of the soil contacting the driver is increased and the strength of the material reduces wear. The middle rod portion may be may be made of a relatively weaker material compared to the impact end, wherein the material still tolerates the forces of the impact, but in the interest of cost, weight and other reasons, does not need to have the strength the bottom impact portion has to withstand contact with the ground or soil. The driving end of each rod may be of any design, such as a wider flat base, or in some circumstances, a cone shape to drive through hard soil layers. These ends may be interchangeable or replaceable to reduce downtime and cost for wear or changing conditions or needs.

In one or more embodiments, which may be in addition to the above and below embodiments, the rod or pile may be shaped in a fashion wherein the rod, pile or driver fits within a particular dimension or is designed for a purpose such as for shipping or transporting.

In one or more embodiments, which may be in addition to the above and below embodiments, the rod is shaped in a fashion wherein the rod, pile or driver is structured in particular dimensions to provide for a strength, weight and cost restraint.

In one or more embodiments, which may be in addition to the above and below embodiments wherein the rods, piles or driver are positioned on the plate in a patterned fashion, and wherein the preferred embodiment may have four rods in a square or H pattern, and wherein each rod is positioned by a set distance from one another.

In one or more embodiments, which may be in addition to the above and below embodiments, wherein above the ground and surrounding a portion of the lower section of the rods or driver, a holding plate or catch fork is designed and structured, wherein the rods travel through recesses or loosely fitting holes in the holding plate or catch fork such that the rods do not push down or transmit force into or on the holding plate or catch fork, but that the catch fork provides lateral stability to the rods, so that the rods are driven straight into the ground. The catch fork or holding plate may be made of any material, and may provide for friction reduction sleeves where the rods go through the holding plate or catch fork. The catch fork may be connected or otherwise structured or connected to the crane or structure on which the rig is mounted so that the catch fork is stationary in terms of the crane and ground plane. The holding plate or catch fork may also be hung or otherwise supported via auxiliary wires, cables or rope to the boom of the crane or other places on the crane. In one or more embodiments, which may be in addition to the above and below embodiments, the catch fork may be formed in a substantially box-type or any other shape or configuration wherein a rod mounting beam that may be fixed vertically at regular interval or, a plurality of rods may be vertically fixed to the lower surface of the device at specified intervals. Additionally the catch fork or rod mounting beam may be connected to the vibration and driving device and mounting plate. The device also may comprise of a box metal holding body allowing the vertical movement of the rod by maintaining the interval between the rods constant. Each rod may be loosely fitted through an insertion hole or recess in the holding body or catch fork. The holding body may be connected to the auxiliary wire rope of the crane.

In one or more embodiments, which may be in addition to the above and below embodiments, there also may be a transducer or damper of which may help position, limit or reduce unwanted force transmitted from the catch fork to the crane or structure. The transducer may be of any type such as foam, rubber, coil spring, or any other type of dampening such as a hydraulic damper. The transducer may also move the catch folk to direct the entire rig along with the crane boom or reposition the impact site.

In one or more embodiments, which may be in addition to the above and below embodiments, the present invention may provide a method to impact the ground soil in any pattern. The pattern may be determined on the needs or purpose of the project and the soil. An embodiment may have a pattern that is based on the soil shape or soil survey wherein specific areas were found to need compaction. The pattern may be to specific distances and depths as set by the operator, and the crane and catch fork may move or position the rods or piles to the specific impact site or sites.

In some embodiments, which may be in addition to the above and below embodiments, the present invention may provide a method to impact the ground soil with rods or piles. The piles or rods may be inserted to a specific depth in a down stroke by the force provided by the driver or vibration and driving device and the weight of the rig, among other possible sources, which in turn compacts the soil as the rods are driven into the soil. The rods are then retracted to a specific depth in an upstroke. The rods, then may be again inserted or forced down to another specific depth in a down stroke, and in turn compacting or solidifying the soil directly under the rods or piles, as well as the soil surrounding the rods and impact areas. The rods or piles may then be retracted to another specific depth in another upstroke, and then reinserted to another depth in another down stroke. This pattern may be repeated, such that the ground soil may be solidified and compacted to fit the needs of the operator.

It is noted that in the above cycle, the rods may be inserted first to the lowest depth in a down stroke, and the subsequent upstroke may be to any depth above the lowest depth. The then, subsequent re insertion down stroke, may be higher than the initial lowest depth, as the soil compacts and solidifies below the rod or pile. The subsequent retraction upstrokes and insertion down strokes, may provide for less and less depth, as over the cycles, the soil becomes compacted at less and less depth, and as such the rod or pile compacts soil at a less and less depth. As such, the rod or pile compacts the soil along the entire distance or depth of the initial insertion, until all the soil is compacted from the initial depth, and surrounding area, to the ground level and surrounding area. It is noted that the depths of the upstroke and down stroke, while above described in be in a preferred embodiment, may also provide for changing down stroke depths, of which may be larger than earlier down strokes. As well as this, the upstrokes may or may not retreat the rods out of the soil or ground completely.

In some embodiments, in addition to the above and below embodiments a material, such as additional soil, or other material, such as solidification material, or other types of soil with desired properties, maybe introduced to the impact site and bores. The material may be introduced as backfill as the rod, driver or pile forces or compacts the existing soil, or may provide for additional material to be compacted, either to provide for more area, or provide or alter the soil with additional or desired characteristics, such as to reduce moisture content for a specific compacted area, or finer or larger grain soil depending on the application. The additional material may be provided through any method, such as a backhoe or tractor, or may be piped or fed through a pressurized line such as in the introduction of concrete. In a preferred embodiment the material is simply pushed into the impact site and bore by a tractor as the piles or rods are retracted, such that the material may provide for backfill as the soil is compacted in a subsequent down stroke, and as such keep the ground plane at the initial height or provide for additional material for compaction.

An auxiliary note is made that the present invention vibration and driving rig may be power by any means, such as a diesel generator, hydraulic system, or electric system as examples. Also, control of the device may be through any means, whether hydraulic, electric and electronic, or lever based, at the rig site, remotely, over a network, on the crane or from and by any means. The present invention may also include sensors, servos, or other devices in which measurements, effects and surveys may be completed, prior, during or after the process and of which allows the device to manually or automatically be adjusted in any manner. This includes printed readouts, display screens, notification monitors, or any user interface, or computer interface system, of which may automatically or manually require input and adjustment depending on the application.

FIG. 1A-1F are component and detailed representations of the present invention vibration rig, according to one or more embodiments.

FIG. 1A is a front view of the present invention direct power compacting rig with a vibration and driving device such as a vibro-hammer. The rig in a preferred embodiment may be connected or hanging from the main cable of a crane over the intended impaction point. A shock absorber or damper 105 may be suspended from the main crane cable wherein, the rig may be suspended below. Attached to the shock absorber or damper 105, through any means, may be the vibro-hammer 104 of which may be of any design or structure as aforementioned. The hammer may connect directly to the distribution plate 103, of which may transfer force to the four adapters 102*a*, 102*b*, 102*c* and 102*d*, of which 102*a* and 102*b* are visible in FIG. 1A. These adapters may transmit force into the rods 101*a*, 101*b*, 101*c*, and 101*d*, of which 101*a* and 101*b* are visible in FIG. 1A. These rods may vibrate or move and impact the ground at a specific force and Hz provided by the vibro-hammer, of which may provide for compaction, vibration and ground improvement.

Figure 1B:
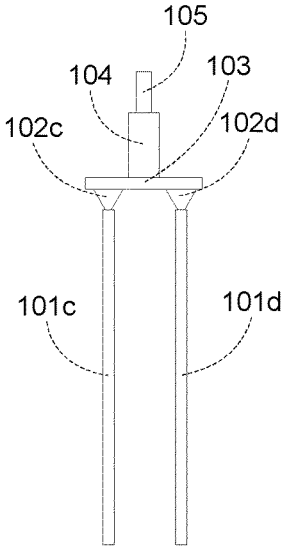

FIG. 1B provides a rear view of the present invention, which is the same structure of that in front view FIG. 1A. FIG. 1B provides for a view of the adapters 102*c* and 102*b* and rods 101*c* and 101*d* of which were not visible in FIG. 1A.

Figure 1C:
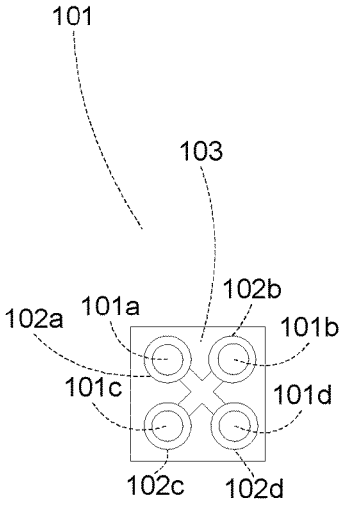

FIG. 1C provides for a component representation of the present invention direct power compacting rig with vibro-hammer 101, wherein the plate 103 is visible and connects to the adapters 102*a*, 102*b*, 102*c*, and 102*d* of which taper to connect to the rods 101*a*, 101*b*, 101*c* and 101*d*.

Figure 1D:
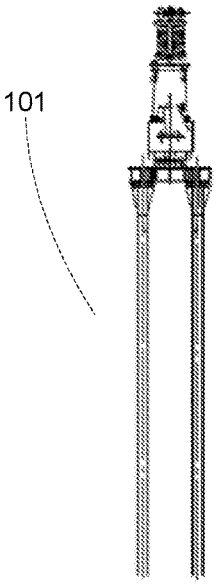

FIG. 1D provides for a detail front view of the direct power compacting rig with vibro-hammer 101 of which is the same view as FIG. 1A, but with details of which are missing in the component view.

Figure 1E:
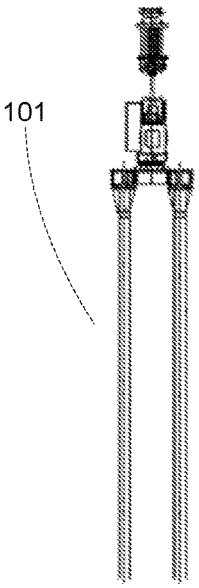

FIG. 1E provides the same rear view of the present invention direct power compacting rig with vibro-hammer 101 as FIG. 1B, but further provides details of which are missing in the component view.

Figure 1F:
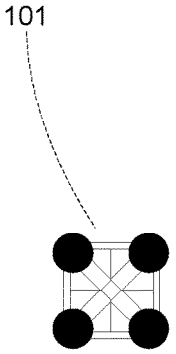

FIG. 1F provides the same bottom view as FIG. 1C but provides further details missing in the component view.

Figure 2:
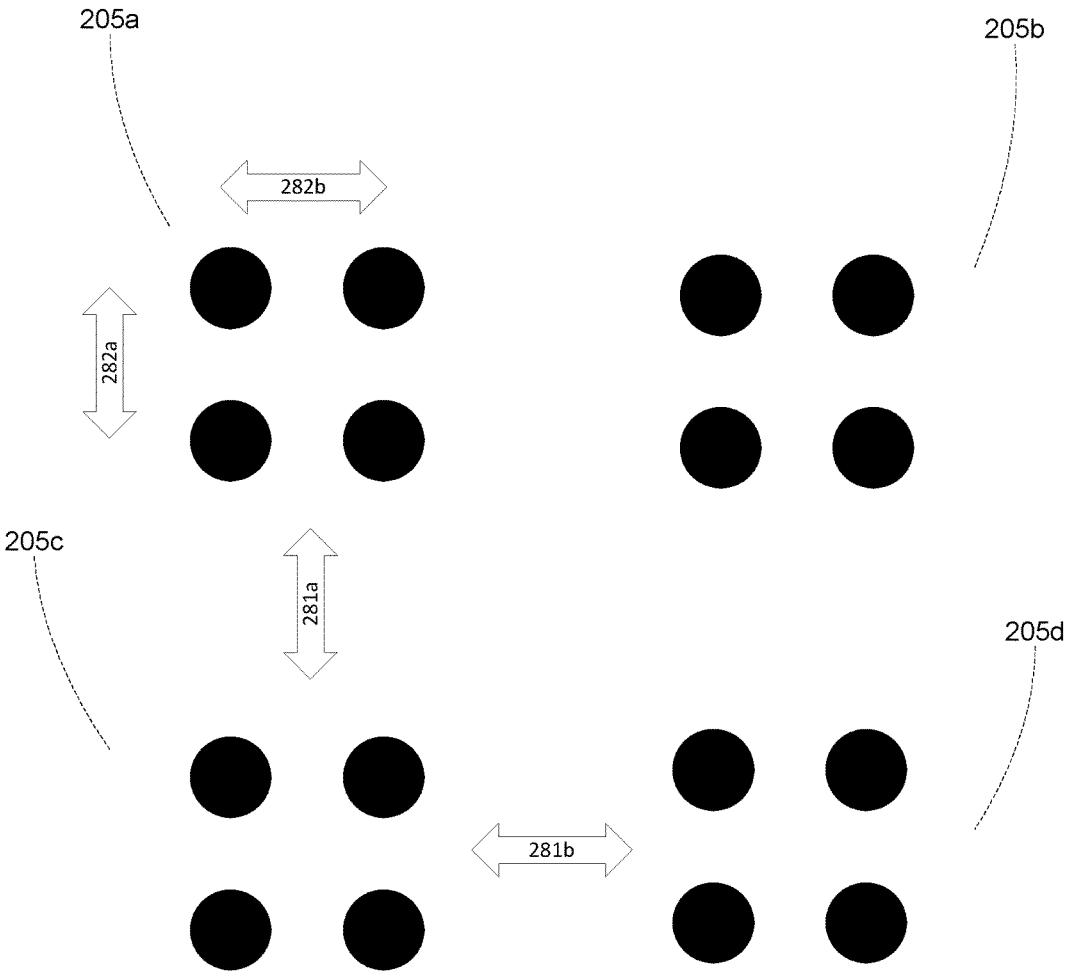
FIG. 2 is an upward facing vertical schematic view of the present invention direct power compacting rig with vibration and driving device, according to one or more embodiments.

FIG. 2 is a downward facing vertical schematic view of the present invention direct power compacting rig impact sites, according to one or more embodiments. FIG. 2 provides a preferred embodiment of a pattern of four group impact points, each with four individual impact sites performed by one rig. Site 205*a* provides for distance between the four individual impact sites in the y-axis as 282*a* and the x-axis as 282*b*. The individual impact sites pacing corresponds to the distance the rods are presented and patterned on the rig. The distance may be of any measurement that is suitable to the conditions and needs and may be designed as such. FIG. 2 also presents three other group impact sites of which each have four individual impact sites. The spacing between the group impact sites is dictated the rig's movement, and the grouped impact sites may be measured by distances in the y axis by a distance 281*a*, as exampled by between sites 205*a* and 205*c* and in the x axis by 281*b*, as exampled between impact sites 205*c* and 205*d*. Each group of four individual impact sites may be performed at once by a rig with four rods or drivers. It is also noted that other patterns and schematics may be used wherein there is a different amount of rods or drivers or necessitated by the terrain or soil.

Figure 3:
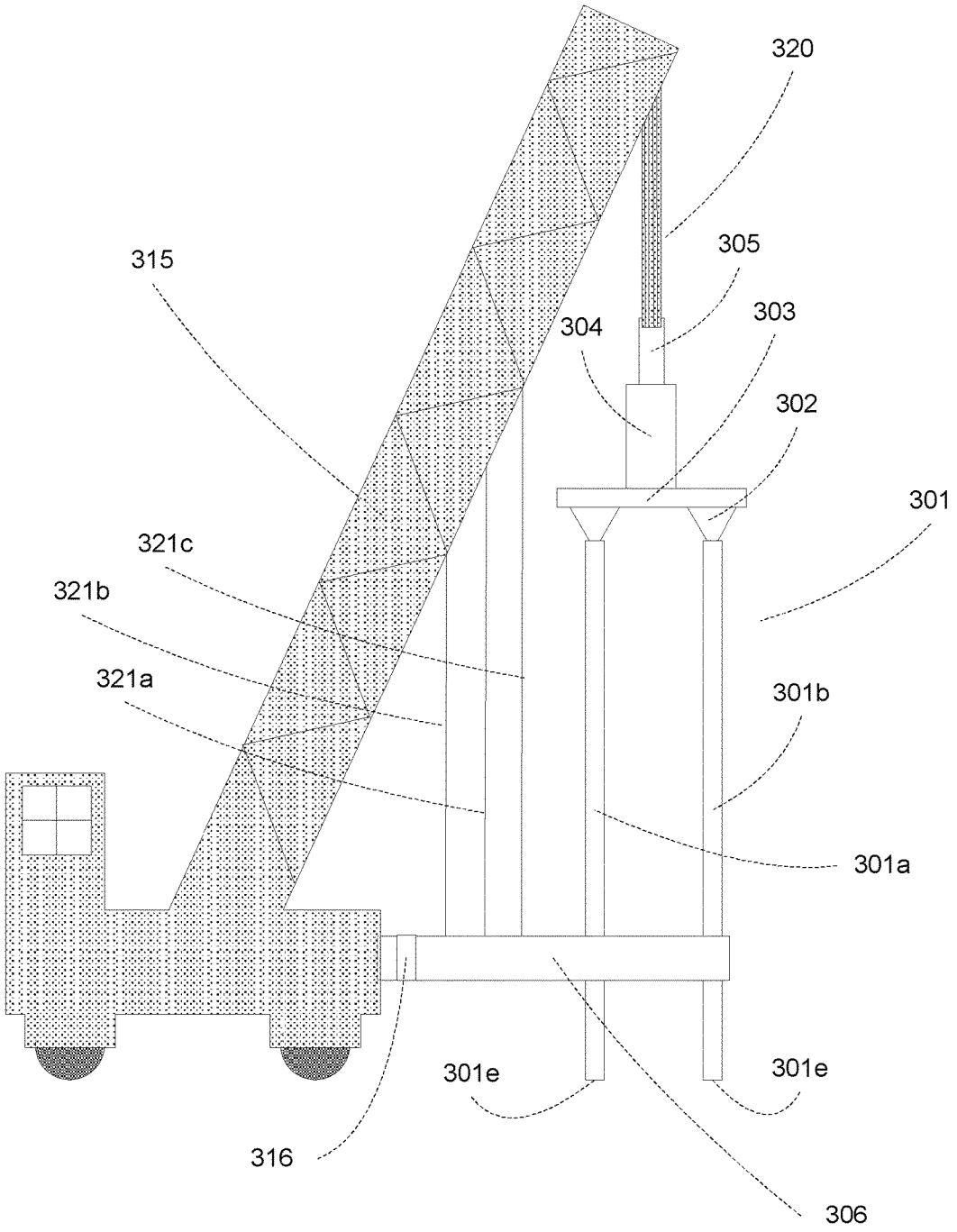
FIG. 3 is component side view of the present invention direct power compacting rig with vibration and driving device mounted on a crane, according to one or more embodiments.

FIG. 3 is component side view of the present invention direct power compacting rig with vibration and driving device such as a vibro-hammer mounted on a crane, according to one or more embodiments. FIG. 3 presents a crane 315 of which the DPC rig 301 is mounted on. The crane 315 may have a main cable 320 of which may be made of steel braided cable, or any other material. The cable 320 may connect to a shock absorber 305, of which may connect to the vibration and driving device or vibro-hammer 304. The hammer may then connect to the adapting plate 303, of which is connected to the adapters 302, of which the adapters are connected to the drivers or rods, of which 301*a* and 302*b* are in view. The rods may run in a square H-pattern formation down to the impact site 301*e*. The rods upon impact may be forced or pushed by the impact from the ground, and may pivot or otherwise undesirably move in the x or z axis. Thus, a holding body or plate 306 may extend from the crane, or other structure, and of which may also be further supported by guy wires or other auxiliary cables 321*a*, 321*b*, and 321*c*, of which may connect by any fashion to the crane or another structure and the holding plate 306. The holding plate 306 may then provide for a recess or loose fitting hole for each respective rod to pass through, and of which the plate may limit the amount of travel the rods may be forced into at any given direction. A transducer or shock absorber 316 may limit the shock impacted into the holding plate and transferred to the crane or structure. The transducer or shock absorber 316 may also aid in the positioning of the rods or drivers and provide further strength.

Figure 4:
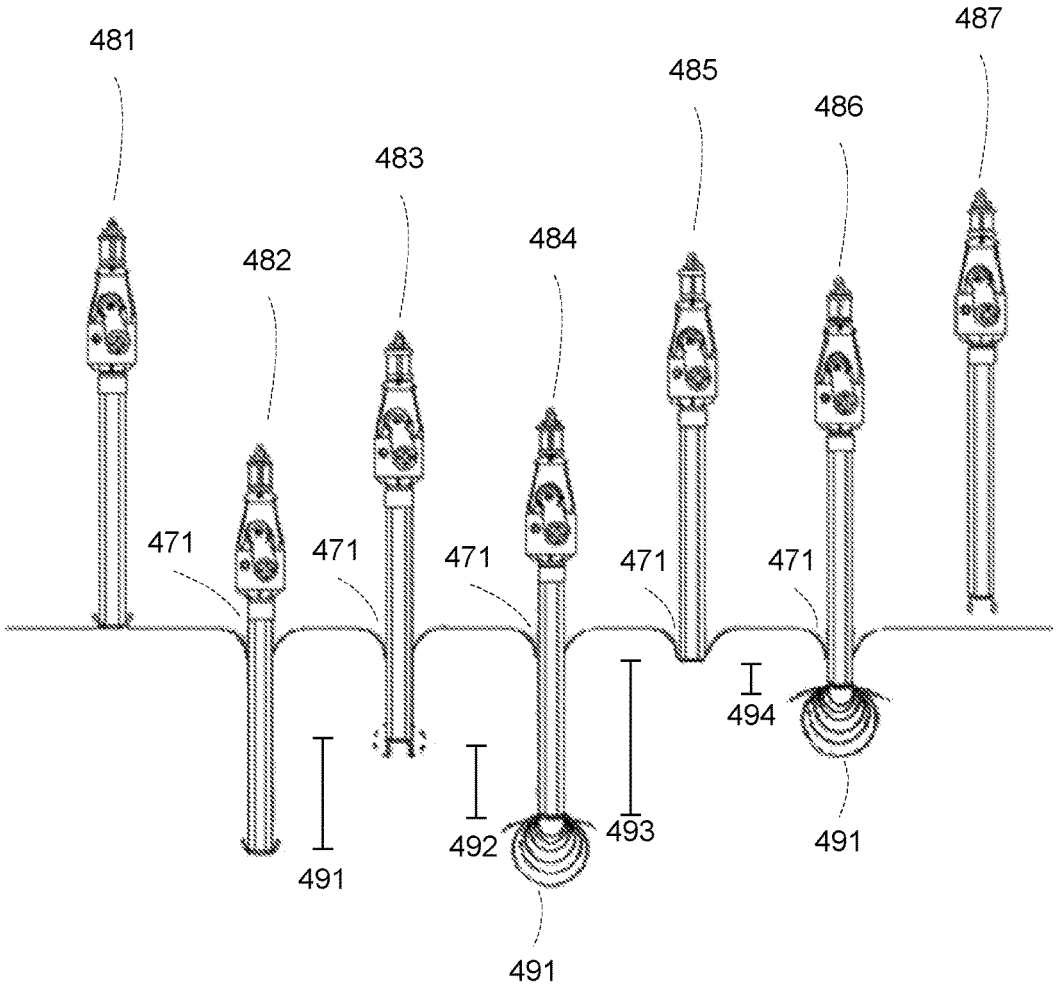
FIG. 4 shows a step-by-step illustration of the compacting method of the present invention direct power compacting rig with vibration and driving device, according to one or more embodiments.

FIG. 4 shows the construction method and steps of the present invention direct power compacting rig with vibro-hammer, according to one or more embodiments. FIG. 4 displays an example embodiment with simplified single rod and vibration rig in different steps 481, 482, 483, 484, 485, 486 and 487, of which each step is in various position of compaction. Rod and vibration rig 481 displays the first position, wherein the rod is resting on the ground prior to any work being done. Rod 482 shows the second step being completed, wherein the rod is inserted or penetrated into the ground to a specific depth in a down stroke. A sand, or other material supply may be provided, at point 471, wherein, the sand may either be stacked around the impact site by a tractor or backhoe, such that when the rod is then later retracted in an upstroke and reinserted or driven down in a down stroke, the material may fall into the bore. It is noted that the rod in upstrokes may be retreated to a point below the ground plane, or may be retracted out of the ground completely, depending on the embodiment and needs of compaction. The introduced material, introduced by a tractor or backhoe piled around the insertion site, then may be used as a backfill to fill the ground as it is compacted so that the ground plane stays level, or may be used as compaction material by falling in the bore and under the rod completely or incompletely and subsequently compacted with the soil material. The material may also be provided through other means, such as through hoses or pipes, wherein the material may be pressured, or introduced at a specific depth. Rod 483 shows the third step completed, wherein the rod is pulled up in an upstroke by a specific distance 491. Rod 484 shows the fourth step completed wherein the rod is inserted again in a down stroke, by a distance 492, and wherein the rod compacts the soil with either just the existing ground soil already in the bore or with additional sand or material provided 471. Rod 485 shows the fifth step completed wherein the rod is pulled up in an upstroke by a depth 493. Rod 486 shows the sixth step wherein the rod is inserted again in a down stroke, wherein the rod compacts the soil either already in the bore, or with additional material 471 provided. As seen in the seventh step, the vibro-hammer and rod 487 may then be pulled up out of the ground, wherein then the ground is then fully compacted, and wherein the rig may be repositioned to another site. Waves 491 show the compaction of the rod or driver transmitted through the soil, such that the soil becomes compacted. These compaction effects may radiate as shown, but also may radiate to the sides of the rods as both the downward force of the rods is applied, as well as the vibration. The soil, being loose, may have large gaps or distance between individual particles, and the compaction may reduce these gaps, making a tighter, harder and more compact soil. The force and vibration transmitted by the vibration and driving device, and subsequently the rods, may perform the aforementioned compaction. It is noted that there may be intermediary steps between each of the aforementioned steps and the numbering is purely for example purposed. Also, it is noted that the steps may be any order and that the depths may vary due to the needs of the operator. The steps may also be repeated in any plurality and patterned, including additional steps, such as additional compaction cycles after the example sixth step and before the example seventh step.

Figure 5:
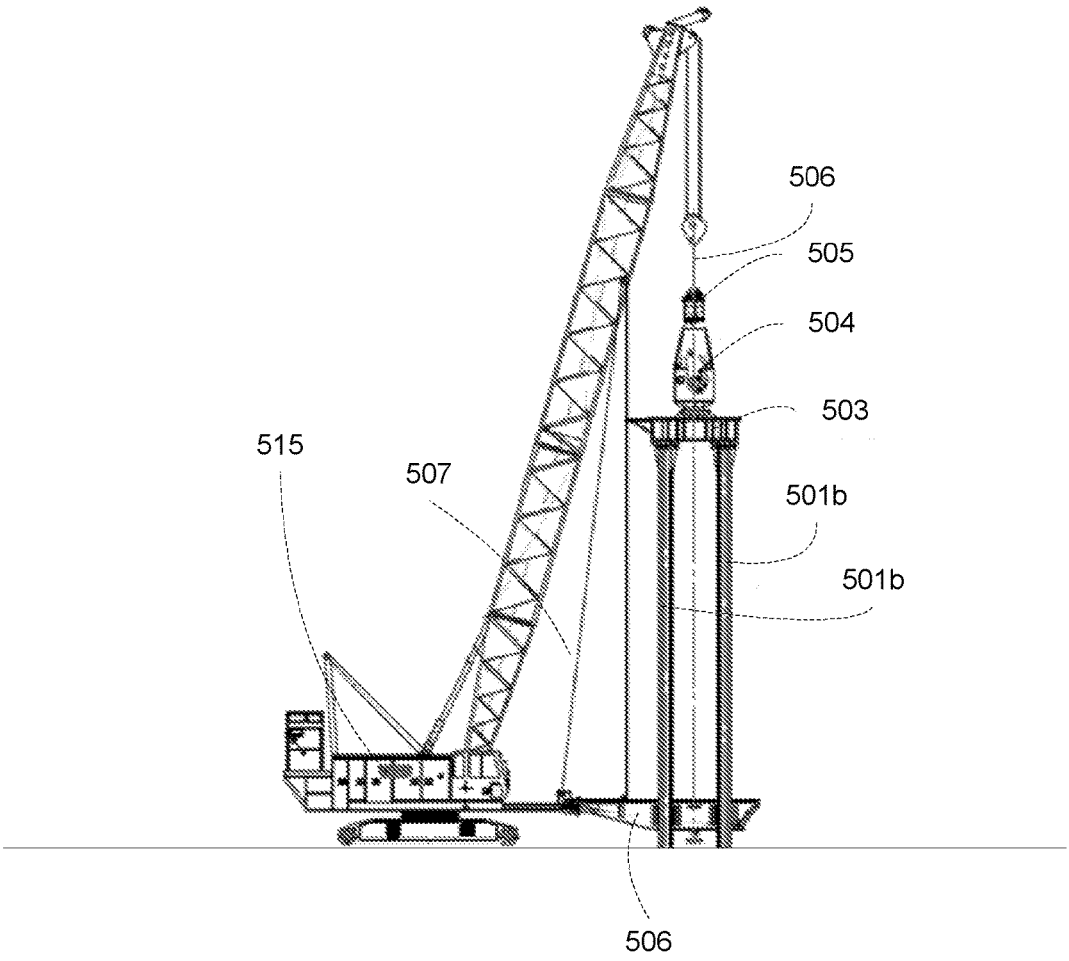
FIG. 5 is a detailed side view of the present invention direct power compacting rig with vibration and driving device, according to one or more embodiments.

FIG. 5 is a detailed side view of the present invention direct power compacting rig with vibration and driving device, according to one or more embodiments. FIG. 5 presents a crane 515 of which provides a main cable 506 which connects to the present invention direct power compacting rig with vibro-hammer 504 of which is connected to the adapter plate and adapters 503, of which connects to rods 501*a* and 501*b*, of which impact and penetrate the ground. There may be a holding plate 506 of which may limit the movement of the rods, and of which may be connected directly or through a transducer or shock absorber to the crane 515 and further supported by guy wires 507.

Figure 6:
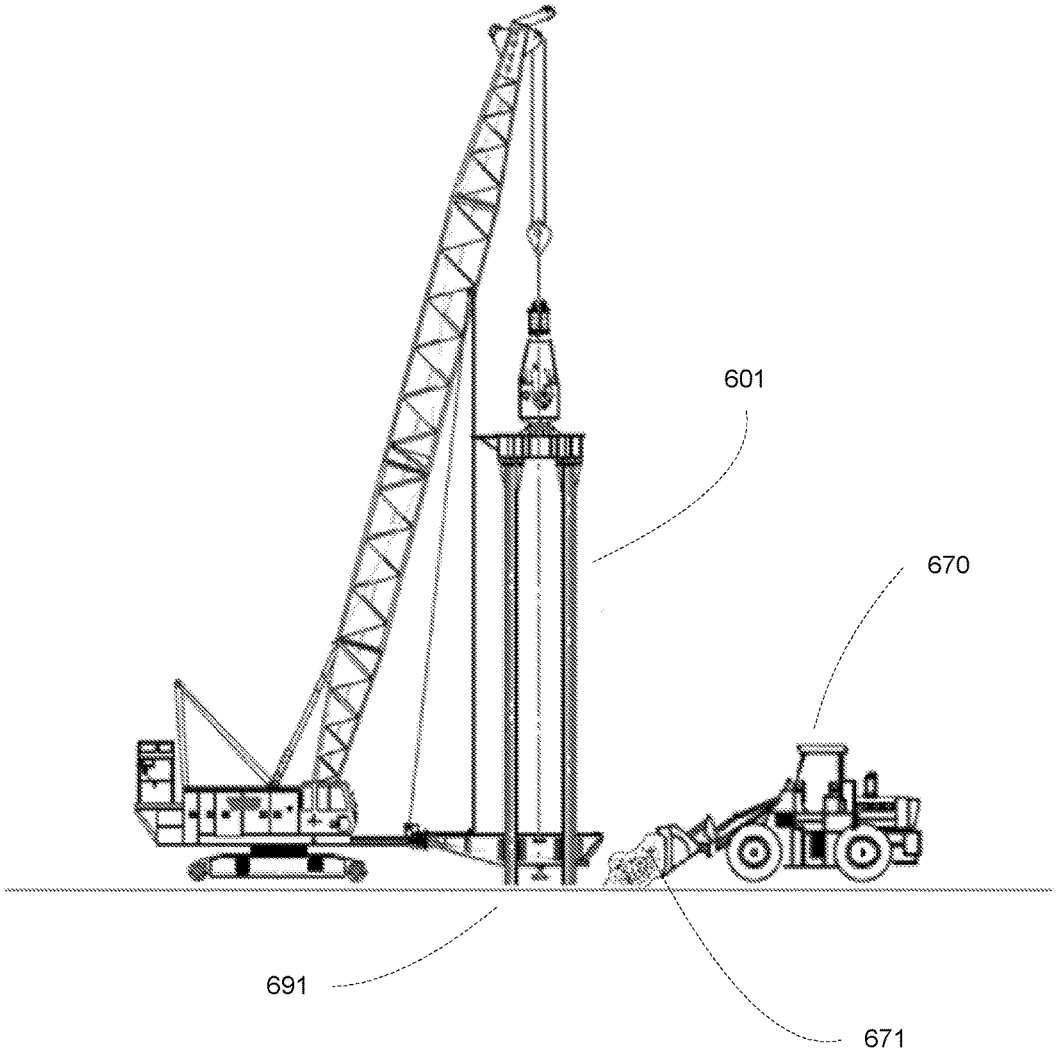
FIG. 6 shows a detailed side view of a construction method of the direct power compacting rig with vibration and driving device, according to one or more embodiments.

FIG. 6 shows a detailed side view of a construction method of the present invention direct power compacting rig with vibration and driving device, according to one or more embodiments. FIG. 6 shows the example step one wherein the vibration rig 601 is positioned over an impact site 691, wherein a tractor or backhoe 670 provides sand or other material 671 to the impact site and the rods are retracted above the ground plane.

Figure 7:
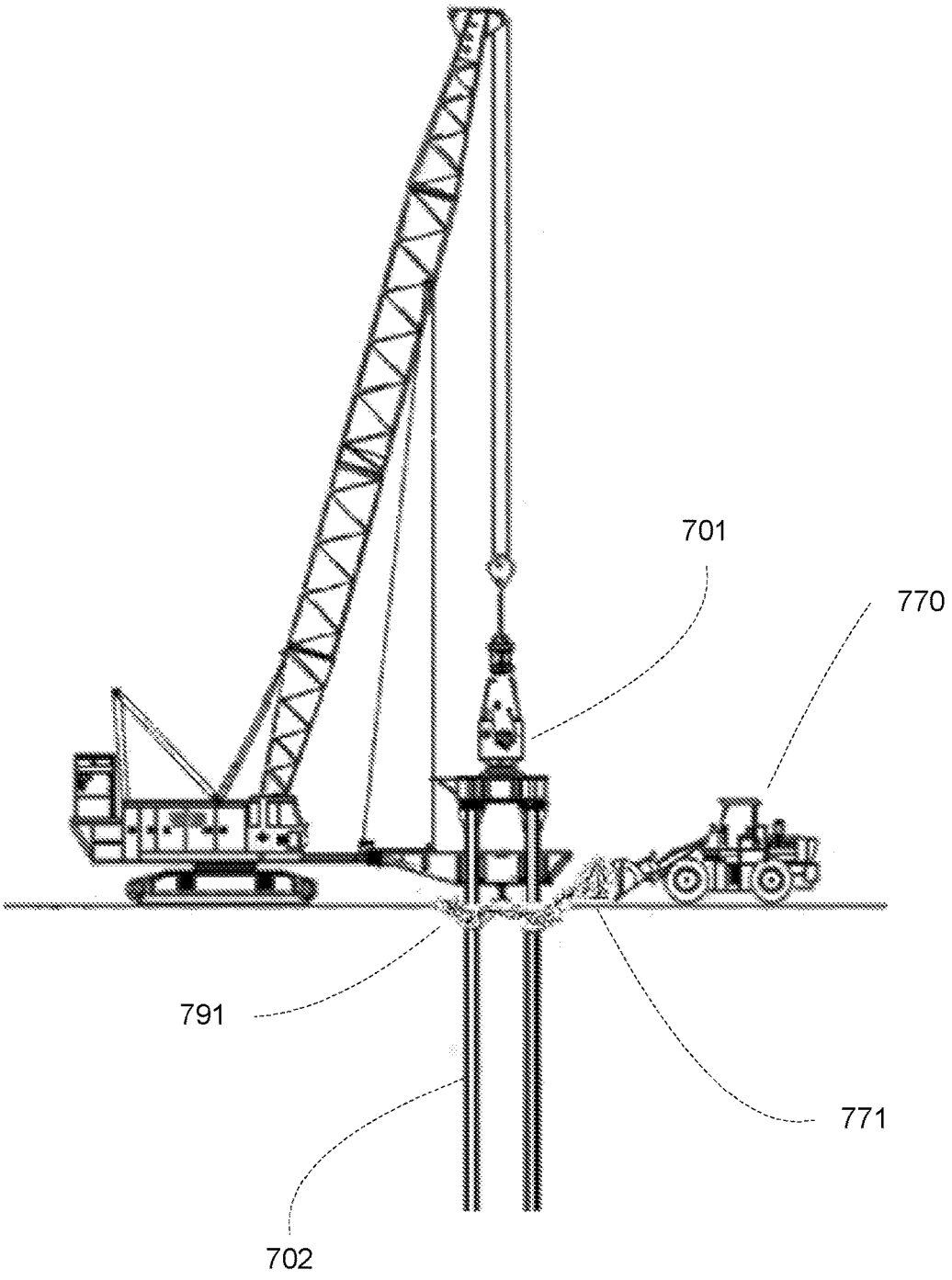
FIG. 7 shows a detailed side view of a construction method of the present invention direct power compacting rig with vibration and driving device, according to one or more embodiments.

FIG. 7 shows a detailed side view of a construction method of the present invention direct power compacting rig with vibration and driving device, according to one or more embodiments. FIG. 7 shows the example step two wherein the direct power compacting rig with vibro-hammer 701 is positioned over an impact site 791, and the rods 702 are inserted or penetrated into the ground at their full depth, or the depth necessary for the current function. A backhoe or tractor 770 may provide sand or another material 771, of which may flow or fall into the bores, simultaneously or after the rods are inserted.

Figure 8:
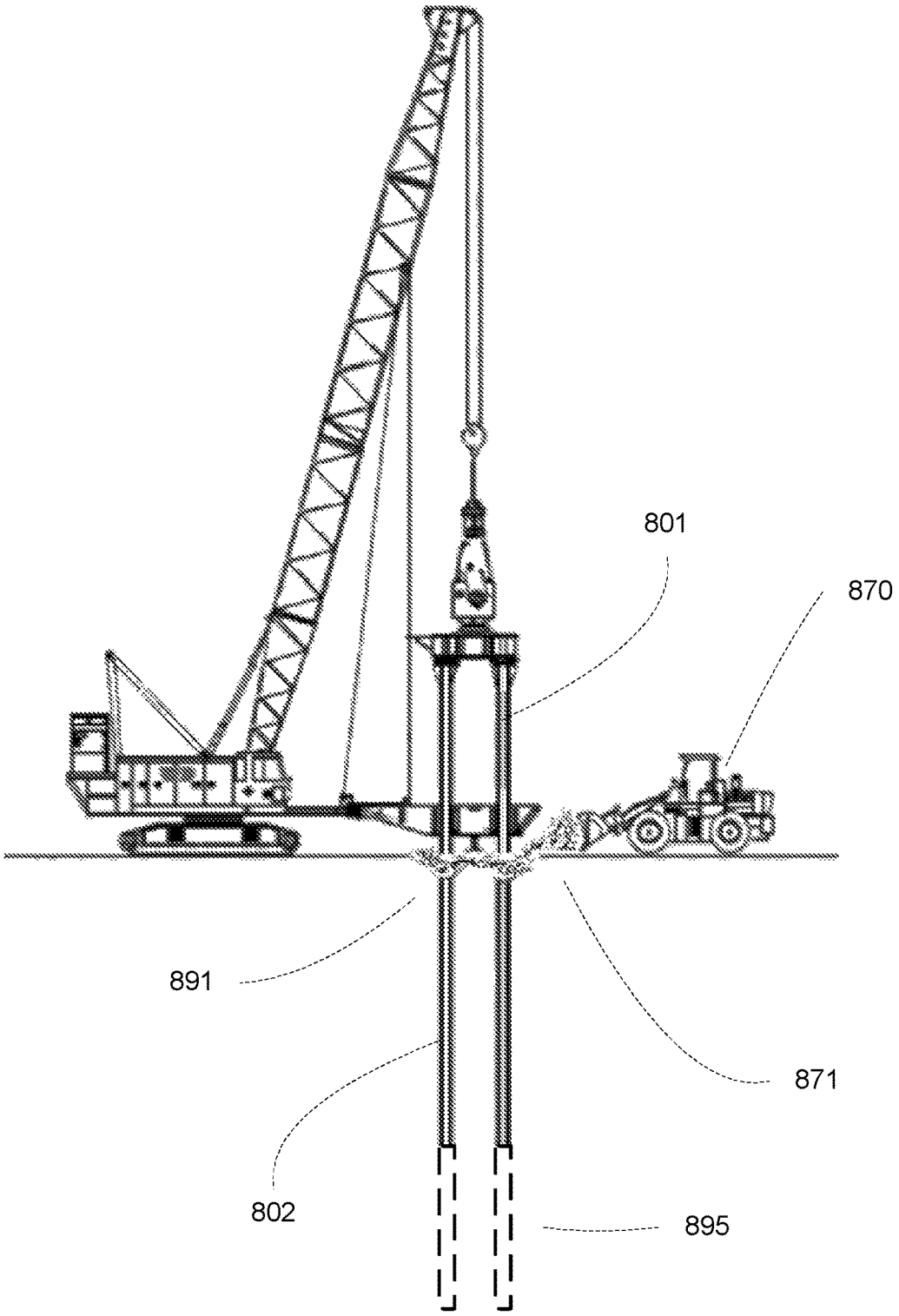
FIG. 8 shows a detailed side view a construction method of the present invention direct power compacting rig with vibration and driving device, according to one or more embodiments.

FIG. 8 shows a detailed side view a construction method of the present invention direct power compacting rig with vibration and driving device, according to one or more embodiments. FIG. 8 shows the example step three wherein the vibration rig 801 is positioned over an impact site 891, and the rods 802 are retreated or moved to a specific higher depth than the depth in example step 2. This may provide or create a cavity or bore 895 of which sand or another material 871, provided by a machine 870, may have fallen into or placed in by the operators, or of which the cavity may be filled of existing loose ground soil caved in or fallen from the walls of the cavity.

Figure 9:
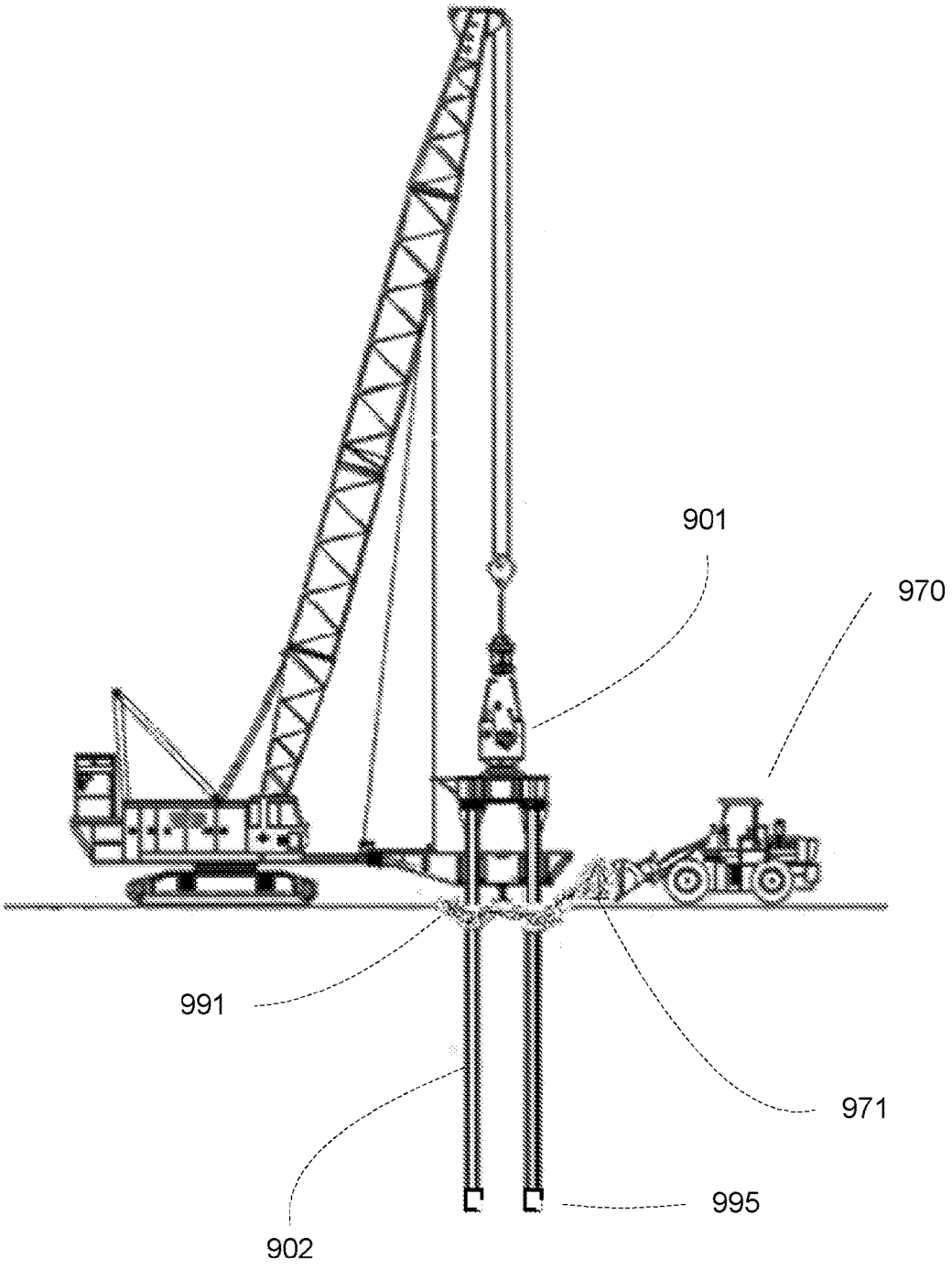
FIG. 9 shows a detailed side view a construction method of the present invention direct power compacting rig with vibration and driving device, according to one or more embodiments.

FIG. 9 shows a detailed side view a construction method of the present invention direct power compacting rig with vibration and driving device, according to one or more embodiments. FIG. 9 shows the example step four wherein the vibration rig 901 is positioned over an impact site 991, and the rods 902 are inserted or penetrated again to a depth, of which compacts the existing ground soil and possibly the material 971 that has been introduced by a machine 970. The re-insertion of the rods may compact the soil and material such that the soil becomes compacted and stronger. Area 995 may be represented as a compaction zone wherein the ground soil solely has become compacted, or the ground soil mixed with the material 971 may be compacted. The compaction area also may radiate out from the impact points, creating a larger area wherein the machine may have influenced and provided strength and compaction as the forces and vibration are transmitted throughout the ground. Also, the vibro-hammer at a specific Hz, may further provide positive effects in compaction that radiates throughout the ground soil and material.

Figure 10:
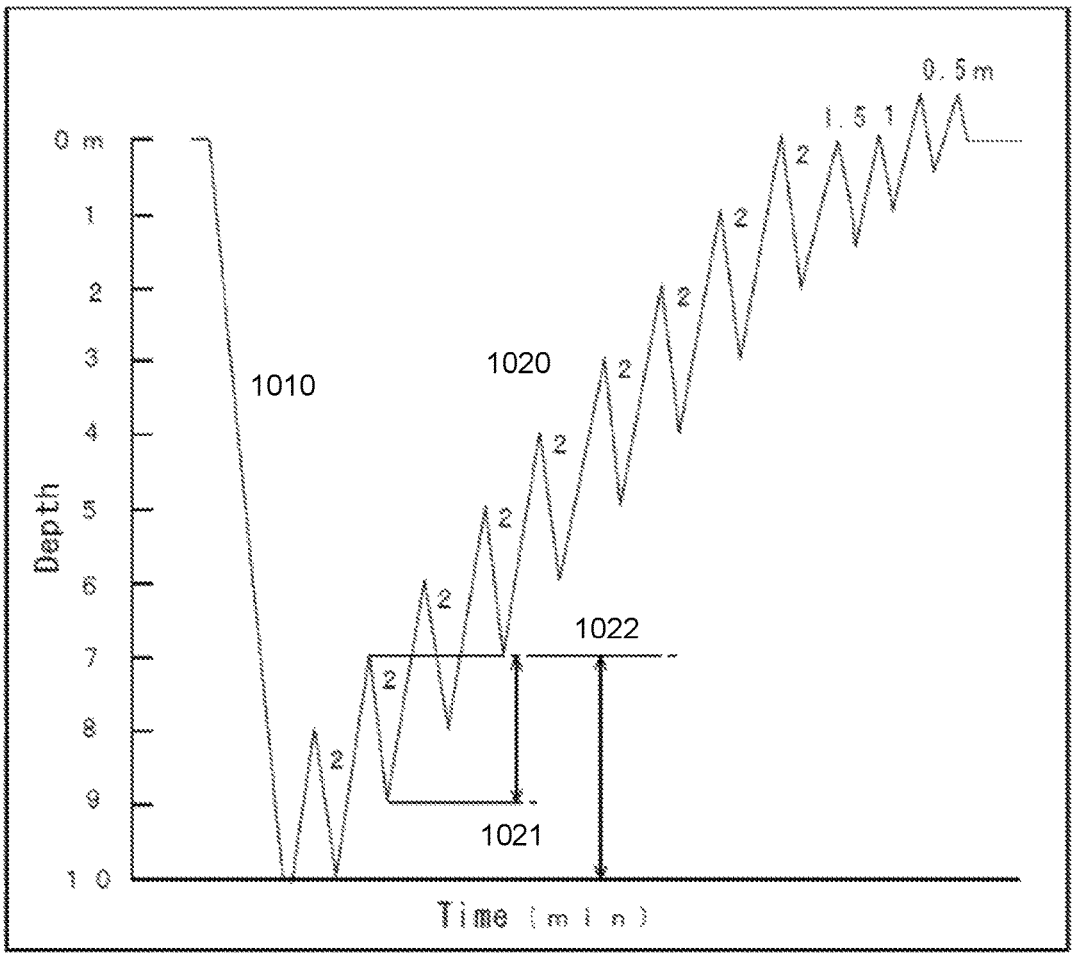
FIG. 10 shows a graphical representation of a construction method of the present invention direct power compacting rig with vibration and driving device, according to one or more embodiments.

FIG. 10 shows a graphical representation of a construction method of the present invention vibration and driving device, according to one or more embodiments. FIG. 10 graph the depth of the rods changing over time with example depths from a study. For instance in area 1010, it is seen that for a given time, the rod depth increases from 0 m to 10 m. Then it is seen in area 1020, the depth increases in an alternating fashion, providing a driving and vibrating motion of up and down strokes, which provides for compaction. For instance, arrow 1021 shows the depth change in a down stroke, while arrow 1022 provides the distance of an upstroke. With an alternating up stroke and down stroke, as the rod is retracted, the ground becomes compacted, as for each upstroke, the rod is retracted and existing or new soil or other material may fill the hole below the driver. On the subsequent down stroke, which is less than the preceding upstroke, the material may be compacted in the area below the rod or driver. The process then repeats, alternating upstrokes and down strokes, such that along the depth of the rod, the ground becomes compacted until the rod fully retreats and the entire depth has been compacted.

Figure 11:
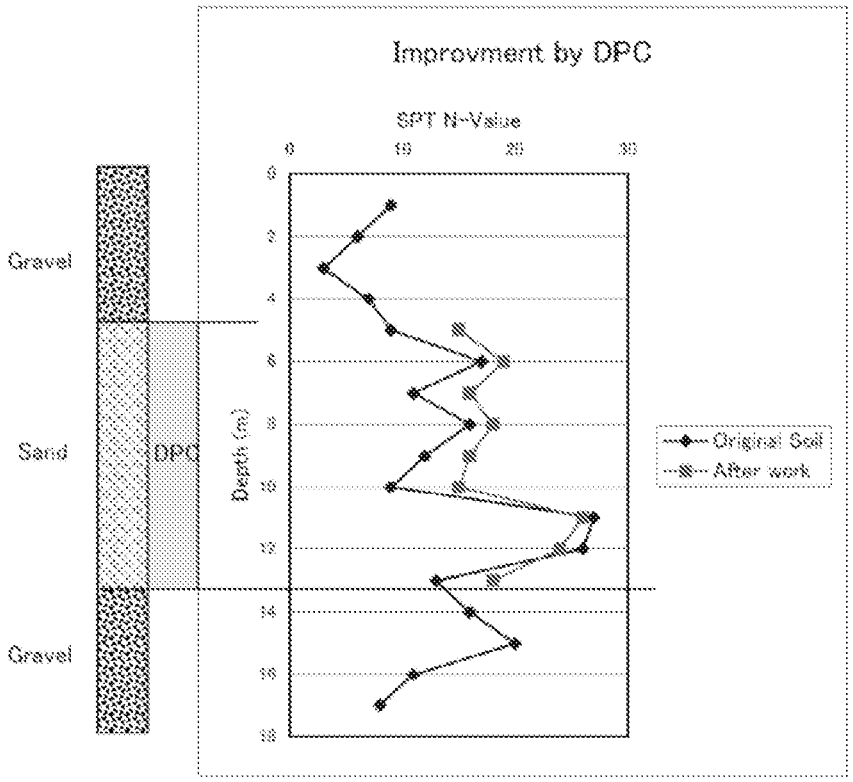
FIG. 11 shows a graphical representation of a construction method of the present invention direct power compacting rig with vibration and driving device, according to one or more embodiments.

FIG. 11 shows a graphical representation of a construction method of the present invention vibration and driving rig, according to one or more embodiments. FIG. 11 provides for a study improvement of a typical use of the present invention. On the graph the x-axis provides for the SPT N-value which is a standard penetration test and good meter of ground strength and penetration resistance, wherein a higher value is considered to be stronger. The y-axis provides for an indicator of depth and soil type. The results of the study provides the black line with diamond indicators representing the penetration values for the existing unmodified soil such as gravel or sand at the respective depths marked and the grey line with square indicators representing the penetration value for the modified soil. In this example, it may be seen that the gray line with square indicators, which represents the ground soil after being modified by the present invention, may be of a higher value than that of the original soil as the SPT N-value for each specific depth and gravel type after modification was improved over the original values.

A number of embodiments have been described. Nevertheless, it will be understood that various modifications may be made without departing from the spirit and scope of the claimed invention. In addition, the methods depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

It may be appreciated that the various systems, methods, and apparatus disclosed herein may be performed in any order. The structures in the figures may be shown as distinct and communicating with only a few specific structures and not others. The structures may be merged with each other, may perform overlapping functions, and may communicate with other structures not shown to be connected in the figures. Accordingly, the specification and/or drawings may be regarded in an illustrative rather than a restrictive sense.

The structures and modules in the figures may be shown as distinct and communicating with only a few specific structures and not others. The structures may be merged with each other, may perform overlapping functions, and may communicate with other structures not shown to be connected in the figures. Accordingly, the specification and/or drawings may be regarded in an illustrative rather than a restrictive sense.

What is claimed is:

1. A method for compacting and improving soil wherein:

providing a ground compacting machine wherein the machine includes four compacting rods in a square pattern, wherein the rods are provided each with a shock absorber and damper, vibro hammer or pile driver, and wherein the rods are placed into a holding plate wherein each rod respectfully fits in a loosely fitted hole in the holding plate, such that the rods can slide vertically with limited horizontal motion in relation to each other and from deflection forces from the ground, positioning the rods over an insertion site, inserting the rods into the ground at the respective insertion site, such that a force and vibration is transmitted into the ground, such that the ground soil is compacted, driving the rods into the ground up a specific initial downstroke depth, and wherein the compaction is provided in a cycle, wherein:

retreating the rods to a certain upstroke depth, higher than the initial downstroke depth, driving the rods to a subsequent downstroke depth, higher than the initial downstroke depth, retreating the rods to a subsequent upstroke depth, driving the rods to a second subsequent down stroke depth, higher than the subsequent downstroke depth, and retreating the rods to a second subsequent upstroke depth.

2. A method continued as in claim 1, wherein:

the cycle is continued wherein:

raising and lowering the rods in a cycle of the downstroke and upstroke depths until the ground is compacted, and retreating the rods out of the ground upon completion.

* * * * *